US011285578B2

(12) United States Patent
Genozono

(10) Patent No.: US 11,285,578 B2
(45) Date of Patent: Mar. 29, 2022

(54) GRINDING APPARATUS

(71) Applicant: DISCO CORPORATION, Tokyo (JP)

(72) Inventor: Jiro Genozono, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 136 days.

(21) Appl. No.: 16/934,626

(22) Filed: Jul. 21, 2020

(65) Prior Publication Data

US 2021/0023674 A1 Jan. 28, 2021

(30) Foreign Application Priority Data

Jul. 26, 2019 (JP) ..... JP2019-137774

(51) Int. Cl.

| | |
|---|---|
| ***B24B 49/04*** | (2006.01) |
| ***B24B 49/18*** | (2006.01) |
| ***B24B 37/013*** | (2012.01) |
| ***B24B 37/30*** | (2012.01) |

(52) U.S. Cl.

CPC ..... *B24B 49/04* (2013.01); *B24B 37/013* (2013.01); *B24B 37/30* (2013.01); *B24B 49/186* (2013.01)

(58) Field of Classification Search

CPC ..... B24B 49/02; B24B 49/04; B24B 49/045; B24B 49/183; B24B 49/186; B24B 37/005; B24B 37/013; B24B 37/30; B24B 7/228

USPC ..... 451/5, 8, 9, 10, 11, 21, 41, 287

See application file for complete search history.

(56) References Cited

U.S. PATENT DOCUMENTS

2018/0056481 A1* 3/2018 Yoshida ..... B24B 49/00

FOREIGN PATENT DOCUMENTS

| | | | | |
|---|---|---|---|---|
| EP | 1107289 | A2 | 6/2001 | |
| EP | 1270148 | A1 * | 1/2003 | ..... B24B 49/16 |
| JP | 2007335458 | A | 12/2007 | |
| JP | 2008073785 | A | 4/2008 | |
| JP | 2015102365 | A | 6/2015 | |
| WO | WO-2018235619 | A1 * | 12/2018 | ..... H01L 21/6836 |

OTHER PUBLICATIONS

English Translation of WO 2018/235619 (Year: 2018).*

* cited by examiner

*Primary Examiner* — Monica S Carter
*Assistant Examiner* — Leanna R Lincoln
(74) *Attorney, Agent, or Firm* — Greer Burns & Crain Ltd.

(57) ABSTRACT

A height of an upper surface of a sub-chuck table is measured by a holding surface measuring unit in contact with the upper surface of the sub-chuck table. A height of a holding surface of a chuck table is measured by an upper surface height measuring unit in contact with the holding surface of the chuck table. A first difference between the height of the upper surface of the sub-chuck table and the height of the holding surface of the chuck table is calculated. A workpiece is held on the holding surface, and the height of the upper surface of the sub-chuck table is calculated again by the holding surface measuring unit. The upper surface height measuring unit is brought into contact with the upper surface of the workpiece by vertically moving it, and the height of the upper surface of the workpiece is measured.

2 Claims, 3 Drawing Sheets

GRINDING APPARATUS

BACKGROUND OF THE INVENTION

Field of the Invention

The present invention relates to a grinding apparatus.

Description of the Related Art

A grinding apparatus that grinds a workpiece includes a holding surface height measuring gage that measures a height of a holding surface of a chuck table and an upper surface height measuring gage that measures a height of an upper surface of the workpiece held on the holding surface. A thickness of the workpiece is calculated by obtaining a difference between the height of the holding surface which height is measured by the holding surface height measuring gage and the height of the upper surface of the workpiece which height is measured by the upper surface height measuring gage.

In calculation of a wear amount of grinding stones provided to the grinding apparatus, the workpiece held on the holding surface is ground by pressing down the grinding stones against the workpiece until the thickness calculated as described above becomes a thickness set in advance, and a height position of the grinding stones when the grinding is ended is stored in a storage apparatus provided to the grinding apparatus or the like. In addition, the height of the grinding stones when the lower surfaces of the grinding stones are in contact with the holding surface is stored as a reference height in advance, and a difference between a height position higher than the reference height by the thickness of the workpiece at a time of an end of the grinding and the position of the grinding stones when the grinding is ended is calculated as the wear amount of the grinding stone.

SUMMARY OF THE INVENTION

However, when the workpiece has a large thickness, the upper surface height measuring gage cannot rise to the upper surface of the workpiece, and cannot measure the height of the upper surface of the workpiece. In addition, when the holding surface becomes dirty, the thickness of the workpiece cannot be measured normally.

It is accordingly an object of the present invention to provide a grinding apparatus that can measure the thickness of a workpiece even when the thickness of the workpiece is large without being affected by dirt on the holding surface of a chuck table, and further identify a wear amount of grinding stones.

In accordance with an aspect of the present invention, there is provided a grinding apparatus including a chuck table configured to hold a workpiece on a holding surface, a grinding unit configured to grind an upper surface of the workpiece held on the holding surface by a lower surface of a grinding stone, a grinding feed mechanism configured to grinding-feed the grinding unit in a direction perpendicular to the holding surface, a holding surface height measuring unit configured to measure a height of the holding surface, an upper surface height measuring unit configured to measure a height of the upper surface of the workpiece held on the holding surface, a sub-chuck table disposed so as to be separated from the chuck table by a predetermined distance in a horizontal direction, a measuring unit moving mechanism configured to move, in the grinding feed direction, a base on which the upper surface height measuring unit and the holding surface height measuring unit are arranged, and a thickness calculating section configured to move the base by the measuring unit moving mechanism, and calculate a thickness of the workpiece using respective measured values of the upper surface height measuring unit and the holding surface height measuring unit. The thickness calculating section calculates a first difference between the height of the holding surface, the height of the holding surface being measured by the upper surface height measuring unit, and a height of an upper surface of the sub-chuck table, the height of the upper surface of the sub-chuck table being measured by the holding surface height measuring unit, calculates a second difference between the height of the upper surface of the workpiece held on the holding surface, the height of the upper surface of the workpiece being measured by the upper surface height measuring unit, and the height of the upper surface of the sub-chuck table, the height of the upper surface of the sub-chuck table being measured by the holding surface height measuring unit, and calculates the thickness of the workpiece by subtracting the first difference from the second difference.

Preferably, the above-described grinding apparatus further includes a storage unit configured to store a height of the lower surface of the grinding stone set in contact with the holding surface, and a wear amount calculating section configured to calculate a wear amount of the grinding stone by adding the thickness of the workpiece calculated by the thickness calculating section at a time of an end of grinding to the value stored in the storage unit, and subtracting a height position of the grinding stone at the time of the end of the grinding from a resulting addition value.

The holding surface height measuring unit and the upper surface height measuring unit can be raised and lowered by using the measuring unit moving mechanism provided to the grinding apparatus, and a first contact of the holding surface height measuring unit can be brought into contact with the upper surface of the sub-chuck table by disposing the sub-chuck table in vicinity of the chuck table.

Thus, the thickness of the workpiece can be measured without being affected by dirt on the holding surface by bringing a second contact of the upper surface height measuring unit into contact with the holding surface of the chuck table while setting the first contact in contact with the upper surface of the sub-chuck table, obtaining the first difference as a difference between the height of the holding surface and the height of the upper surface of the sub-chuck table, then bringing the second contact into contact with the upper surface of the workpiece while setting the first contact in contact with the upper surface of the sub-chuck table again in a state in which the workpiece is held on the holding surface, obtaining the second difference as a difference between the height of the upper surface of the workpiece and the height of the upper surface of the sub-chuck table, and subtracting the first difference from the second difference.

In addition, a wear amount of the grinding stone can be identified by storing, in the storage unit provided to the grinding apparatus, the height of the lower surface of the grinding stone when the lower surface of the grinding stone is in contact with the holding surface and the height of the lower surface of the grinding stone at a time of an end of grinding, adding the thickness of the workpiece to the value of the height of the lower surface of the grinding stone when the lower surface of the grinding stone is in contact with the holding surface, and subtracting the height of the lower surface of the grinding stone at the time of the end of the grinding from a resulting addition value.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

1 Configuration of Grinding Apparatus

Figure 1:
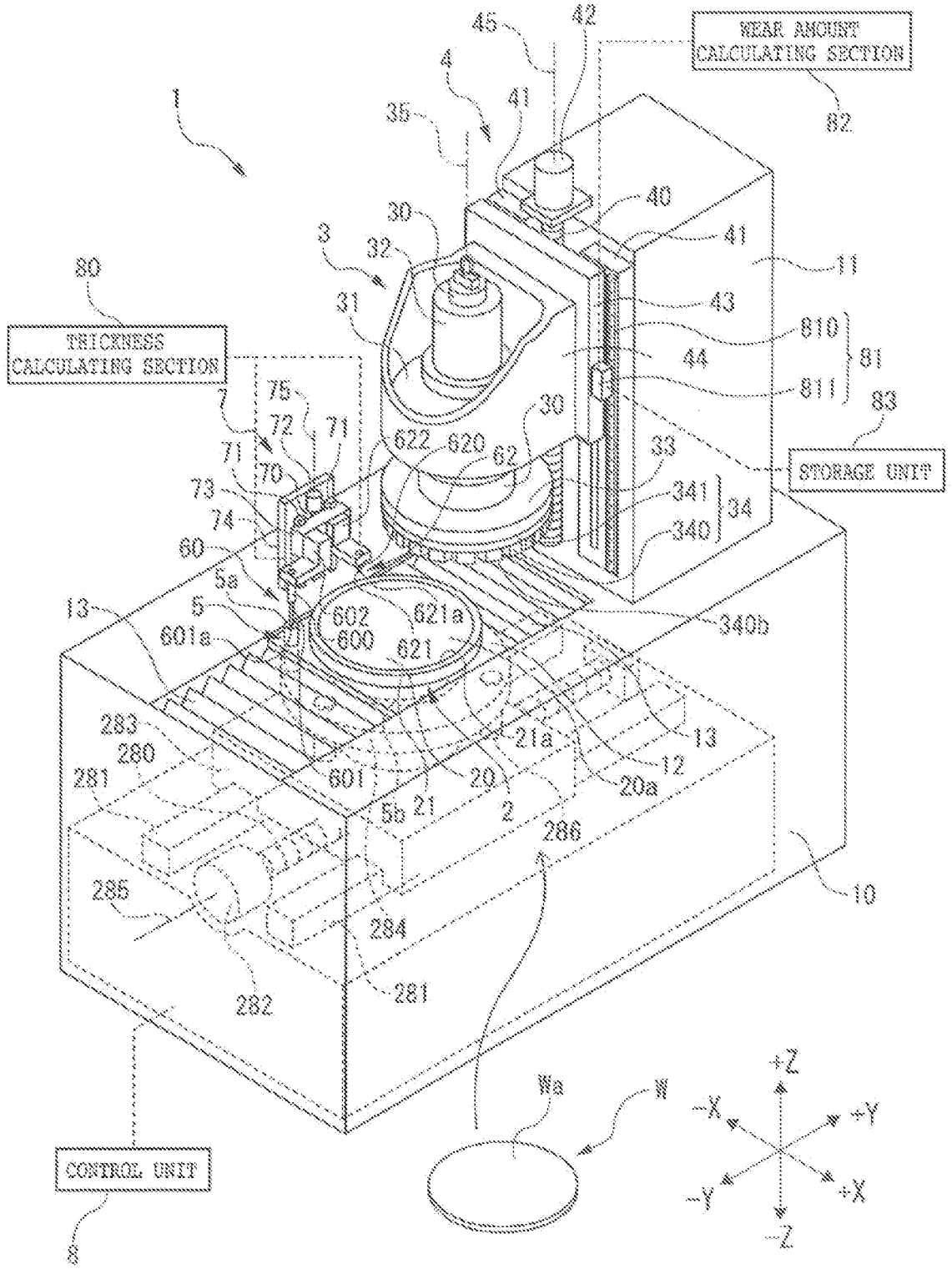
FIG. 1 is a perspective view illustrating a whole of a grinding apparatus.

A grinding apparatus 1 illustrated in FIG. 1 is a grinding apparatus that grinds a workpiece W such as a semiconductor wafer or the like held on a holding surface 20*a* of a chuck table 2 by using a grinding unit 3. A configuration of the grinding apparatus 1 will be described in the following. The grinding apparatus 1 includes an apparatus base 10 extended in a Y-axis direction and a column 11 erected on a +Y direction side of the apparatus base 10.

A side surface on a −Y direction side of the column 11 is provided with a grinding feed mechanism 4 that raisably and lowerably supports the grinding unit 3. The grinding unit 3 includes a spindle 30 having a rotational axis 35 in a Z-axis direction, a housing 31 that rotatably supports the spindle 30, a spindle motor 32 that rotation-drives the spindle 30 about the rotational axis 35, an annular mount 33 connected to a lower end of the spindle 30, and a grinding wheel 34 detachably fitted to a lower surface of the mount 33.

The grinding wheel 34 includes a wheel base 341 and a plurality of substantially rectangular parallelepipedic grinding stones 340 annularly arranged on a lower surface of the wheel base 341. Lower surfaces 340*b* of the grinding stones 340 constitute a grinding surface for grinding the workpiece W.

The grinding feed mechanism 4 includes a ball screw 40 having a rotational axis 45 in the Z-axis direction, a pair of guide rails 41 arranged in parallel with the ball screw 40, a Z-axis motor 42 that rotates the ball screw 40 about the rotational axis 45, a raising and lowering plate 43 whose inner nut is screwed onto the ball screw 40 and whose side portion is in sliding contact with the guide rails 41, and a holder 44 that is coupled to the raising and lowering plate 43 and supports the grinding unit 3.

When the Z-axis motor 42 drives the ball screw 40, and the ball screw 40 rotates about the rotational axis 45, the raising and lowering plate 43 correspondingly moves vertically in the Z-axis direction while guided by the guide rails 41, and the grinding unit 3 held by the holder 44 correspondingly moves in a direction perpendicular to the holding surface 20*a* (Z-axis direction).

The grinding apparatus 1 includes a lower surface height identifying unit 81 that identifies a height of the lower surfaces 340*b* of the grinding stones 340. The lower surface height identifying unit 81, for example, includes a scale 810 disposed on a side surface on the −Y direction side of the guide rails 41, and a reading unit 811 disposed on a side surface on a +X direction side of the raising and lowering plate 43 and at a position adjacent to the scale 810.

The reading unit 811, for example, has an optical type identifying mechanism or the like that reads light reflected from graduations formed on the scale 810. The reading unit 811 can thus identify the graduations on the scale 810. The reading unit 811 is electrically connected to a storage unit 83 including a storage element such as a memory or the like. When the raising and lowering plate 43 moves vertically in the Z-axis direction at a time of upward or downward movement of the grinding stones 340 in the Z-axis direction, the reading unit 811 also moves vertically, and a height position of the reading unit 811 is changed.

The lower surface height identifying unit 81 can store the value of a read graduation on the scale 810 in the storage unit 83. The height position of the reading unit 811 is associated with the height of the lower surfaces 340*b* of the grinding stones 340. The height of the lower surfaces 340*b* of the grinding stones 340 can be measured, on the basis of the height position of the reading unit 811, and the measured value can be stored in the storage unit 83.

The chuck table 2 is disposed on the apparatus base 10. The chuck table 2, for example, includes a sucking portion 20 including a porous member or the like and a frame body 21 supporting the sucking portion 20. An upper surface of the sucking portion 20 is the holding surface 20*a* on which the workpiece W is held. An upper surface 21*a* of the frame body 21 is formed flush with the holding surface 20*a*.

The chuck table 2 is, for example, connected to a horizontal moving mechanism 28 disposed within the apparatus base 10. The chuck table 2 can move in the Y-axis direction by being driven by the horizontal moving mechanism 28. The horizontal moving mechanism 28 includes a ball screw 280 having a rotational axis 285 in the Y-axis direction, a pair of guide rails 281 arranged in parallel with the ball screw 280, a Y-axis motor 282 that rotates the ball screw 280 about the rotational axis 285, a Y-axis base 283 whose inner nut is screwed onto the ball screw 280 and whose bottom portion is in sliding contact with the guide rails 281, and a chuck table base 284 that is coupled to the Y-axis base 283 via supporting columns 286 and supports the chuck table 2. When the Y-axis motor 282 drives the ball screw 280, and the ball screw 280 rotates about the rotational axis 285, the Y-axis base 283 correspondingly moves in the Y-axis direction while guided by the guide rails 281, and the chuck table 2 retained by the chuck table base 284 correspondingly moves in the Y-axis direction parallel with the holding surface 20*a*.

A cover 12 and bellows 13 coupled to the cover 12 so as to be expanded and contracted freely are arranged on periphery of the chuck table 2. When the chuck table 2 moves in the Y-axis direction, the cover 12 moves in the Y-axis direction integrally with the chuck table 2, and the bellows 13 expand and contract.

A sub-chuck table 5 in a cylindrical shape, for example, is disposed at a position separated by a predetermined distance in a horizontal direction from the chuck table 2 on the cover 12. The sub-chuck table 5 is non-rotatably fixed to an upper surface of the chuck table base 284 that rotatably supports the chuck table 2 via a bearing 5*b* (see FIG. 2 and FIG. 3).

A holding surface height measuring unit 60 for measuring the height of the holding surface 20*a* and an upper surface height measuring unit 62 for measuring the height of the upper surface of the workpiece W are arranged above the apparatus base 10. In addition, a measuring unit moving mechanism 7 that moves the holding surface height measuring unit 60 and the upper surface height measuring unit 62 in a grinding feed direction (Z-axis direction) is disposed above the apparatus base 10.

As illustrated in FIG. 1, the measuring unit moving mechanism 7 includes a back plate 74 erected in the Z-axis direction, a ball screw 70 disposed on a side surface on the +X direction side of the back plate 74 and having a rotational axis 75 in the Z-axis direction, a pair of guide rails 71 arranged in parallel with the ball screw 70, a motor 72 that rotates the ball screw 70 about the rotational axis 75, and a base 73 whose side portion is in sliding contact with the guide rails 71.

The holding surface height measuring unit 60 and the upper surface height measuring unit 62 are arranged on the base 73. The holding surface height measuring unit 60 includes a first cylinder 600, a first gage 601 housed in the first cylinder 600, and a first coupling member 602 connected and fixed to each of an upper portion of the first cylinder 600 and a side portion of the base 73 and coupling the upper portion of the first cylinder 600 and the side portion of the base 73 to each other. The first gage 601 is supported so as to be able to project in a −Z direction. A lower end of the first gage 601 is provided with a first contact 601*a* that comes into contact with an upper surface 5*a* of the sub-chuck table 5 or the like.

The cylinder 600 can identify an amount of projection of the first gage 601 from the cylinder 600. The cylinder 600 can, for example, identify an amount of projection of the first gage 601 when the first contact 601*a* is brought into contact with the upper surface 5*a* of the sub-chuck table 5. Incidentally, the first gage 601 can project from the cylinder 600 by at least an amount corresponding to the thickness of the workpiece W before a start of grinding.

The upper surface height measuring unit 62 includes a second cylinder 620, a second gage 621 housed in the second cylinder 620, and a second coupling member 622 connected and fixed to each of an upper portion of the second cylinder 620 and a side portion of the base 73 and coupling the upper portion of the second cylinder 620 and the side portion of the base 73 to each other. The second gage 621 is supported so as to be able to project in the −Z direction. A lower end of the second gage 621 is provided with a second contact 621*a* that comes into contact with the holding surface 20*a* of the chuck table 2, an upper surface Wa of the workpiece W, or the like.

The cylinder 620 can identify an amount of projection of the second gage 621 from the cylinder 620. The cylinder 620 can, for example, identify an amount of projection of the second gage 621 when the second contact 621*a* is brought into contact with the holding surface 20*a* of the chuck table 2, the upper surface Wa of the workpiece W, or the like. The second contact 621*a* projects by a small length from a lower end of the second gage 621.

Figure 2:
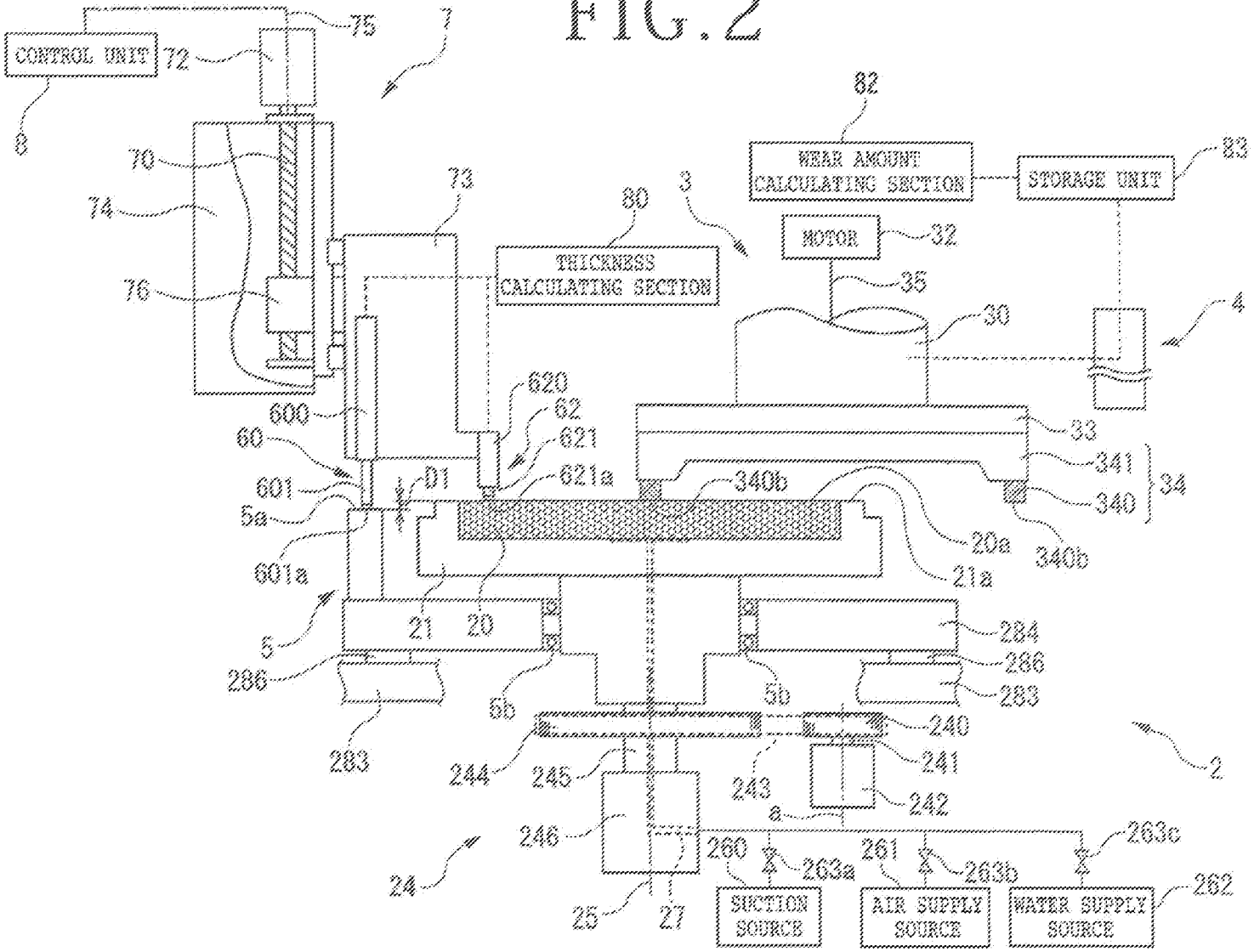
FIG. 2 is a sectional view of the grinding apparatus as viewed from a side in a state in which a contact of an upper surface height measuring unit is in contact with a holding surface of a chuck table.

In addition, as illustrated in FIG. 2, the measuring unit moving mechanism 7 has a nut portion 76 screwed onto the ball screw 70 and coupled to the base 73. When the motor 72 drives the ball screw 70, and the ball screw 70 rotates about the rotational axis 75, the base 73 correspondingly moves vertically in the Z-axis direction while guided by the guide rails 71, and the holding surface height measuring unit 60 and the upper surface height measuring unit 62 arranged on the base 73 correspondingly move vertically in the Z-axis direction integrally with the base 73.

Incidentally, when the base 73 is moved vertically in the Z-axis direction, and the second contact 621*a* projecting from the lower end of the second gage 621 by a small length is brought into contact with the upper surface Wa of the workpiece W held on the holding surface 20*a* of the chuck table 2, the first gage 601 can project from the cylinder 600 by a length such that the first contact 601*a* can be brought into contact with the upper surface 5*a* of the sub-chuck table 5.

As illustrated in FIG. 2, a rotating mechanism 24 is provided below the chuck table 2. The rotating mechanism 24 includes a driving shaft 241 rotatable about a rotational axis a in the Z-axis direction, a motor 242 that rotates the driving shaft 241, a driving pulley 240 coupled to an upper end of the driving shaft 241, a spindle 245 coupled to a lower portion of the chuck table 2 and having a rotational axis 25 in the Z-axis direction, a driven pulley 244 connected to the spindle 245, a transmission belt 243 that is wound around the driving pulley 240 and the driven pulley 244 and transmits a driving force of the driving pulley 240 to the driven pulley 244, and a rotary joint 246 coupled to a lower end of the spindle 245.

When the driving shaft 241 is rotated by using the motor 242, the driving pulley 240 coupled to the driving shaft 241 rotates, and a rotational force of the driving pulley 240 is transmitted to the driven pulley 244 by the transmission belt 243, so that the driven pulley 244 rotates. When the driven pulley 244 rotates, the spindle 245 connected to the driven pulley 244 rotates about the rotational axis 25 in the Z-axis direction, and the chuck table 2 connected to the spindle 245 rotates about the rotational axis 25.

A suction source 260, an air supply source 261, and a water supply source 262 are arranged below the chuck table 2. The suction source 260, the air supply source 261, and the water supply source 262 are each connected to the sucking portion 20 through a flow passage 27. Opening and closing valves 263*a* to 263*c* are respectively arranged between the sucking portion 20 and the suction source 260, between the sucking portion 20 and the air supply source 261, and between the sucking portion 20 and the water supply source 262 in the flow passage 27.

Figure 3:
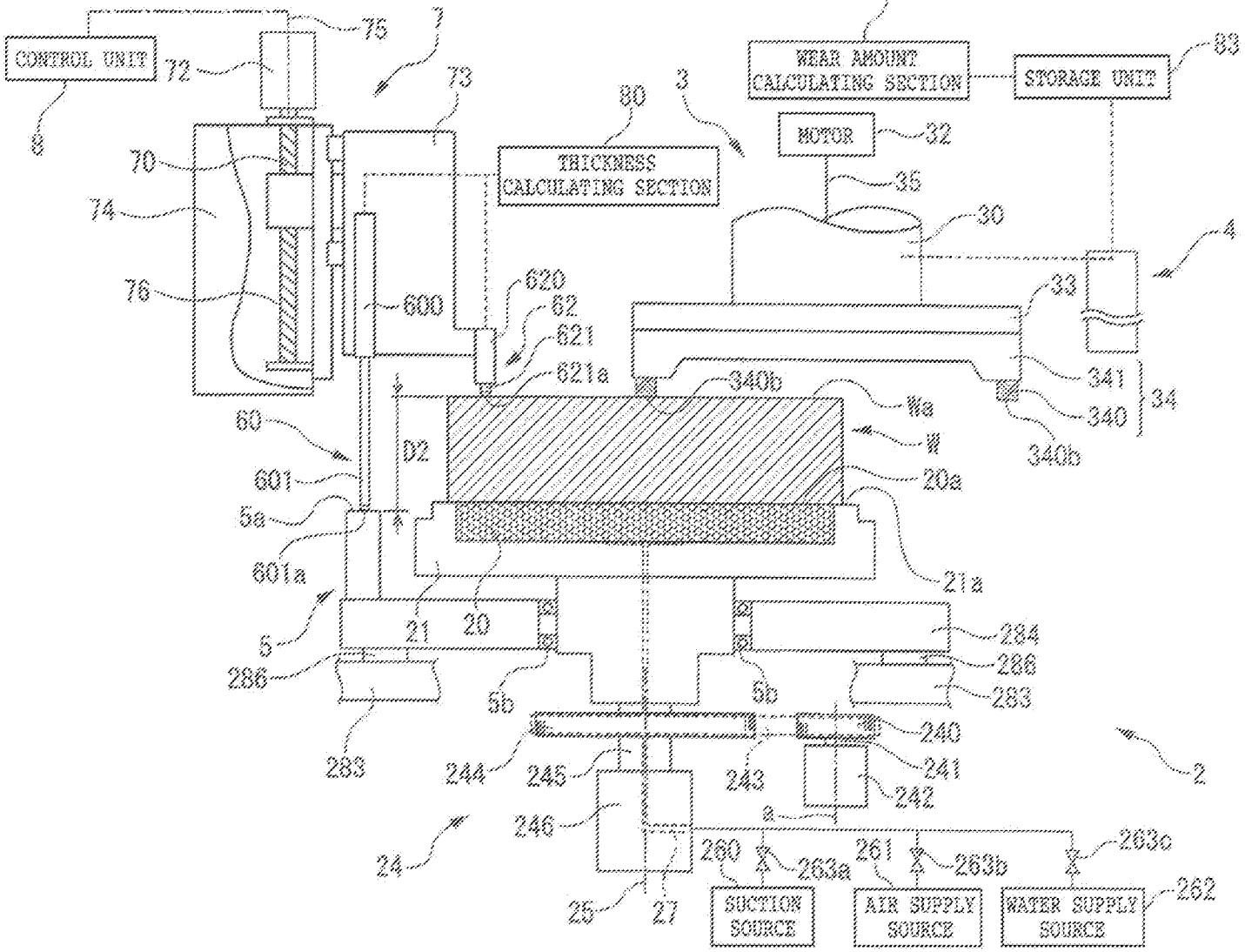
FIG. 3 is a sectional view of the grinding apparatus as viewed from the side in a state in which the contact of the upper surface height measuring unit is in contact with an upper surface of a workpiece held on the holding surface of the chuck table.

Each of the opening and closing valves 263*a* to 263*c* is controlled to be opened and closed as appropriate in grinding of the workpiece W and measurement of the thickness of the workpiece W. For example, as illustrated in FIG. 3, in a state in which the workpiece W is mounted on the holding surface 20*a* of the sucking portion 20, the sucking portion 20 and the suction source 260 are made to communicate with each other by opening the opening and closing valve 263*a* between the suction source 260 and the sucking portion 20, and a suction force exerted by the suction source 260 is transmitted to the holding surface 20*a* by actuating the suction source 260. The workpiece W can be thereby sucked and held on the holding surface 20*a* of the sucking portion 20.

The grinding apparatus 1 includes a control unit 8 that controls various mechanisms provided to the grinding apparatus 1. The control unit 8 includes a thickness calculating section 80 that calculates the thickness of the workpiece W using respective measured values measured by the holding surface height measuring unit 60 and the upper surface height measuring unit 62.

The control unit 8 also includes a wear amount calculating section 82 that has a function of calculating a wear amount of the grinding stones 340 by adding the thickness of the workpiece W, the thickness being calculated by the thickness calculating section 80 at a time of an end of grinding, to the value of the height of the lower surfaces 340*b* of the grinding stones 340 in a state in which the grinding stones 340 are in contact with the holding surface 20*a*, and subtracting the height position of the lower surfaces 340*b* of the grinding stones 340 at the time of the end of the grinding from a value resulting from the addition.

2 Operation of Grinding Apparatus (Grinding and Calculation of Thickness)

The workpiece W is ground to a desired thickness set in advance by grinding the workpiece W while calculating the thickness of the workpiece W by using the grinding apparatus 1 described above. When a plurality of workpieces W are successively ground by using the grinding apparatus 1, the lower surfaces 340*b* of the grinding stones 340 are gradually worn. Eventually, grinding cannot be performed properly. Accordingly, the grinding apparatus 1, for example, calculates the wear amount of the grinding stones 340 after the grinding of the workpiece W or the like.

In the following, description will be made of an operation of the grinding apparatus 1 when the grinding apparatus 1 grinds the workpiece W while calculating the thickness of the workpiece W and an operation of the grinding apparatus 1 when the grinding apparatus 1 calculates the wear amount of the grinding stones 340.

First, as illustrated in FIG. 2, the lower surfaces 340*b* of grinding stones 340 are brought into contact with the holding surface 20*a* of the chuck table 2 located below the grinding unit 3 by moving the grinding unit 3 in the Z-axis direction by using the grinding feed mechanism 4. Then, the storage unit 83 is made to store the height of the lower surfaces 340*b* of the grinding stones 340 when the lower surfaces 340*b* of the grinding stones 340 are in contact with the holding surface 20*a* of the chuck table 2.

The height of the lower surfaces 340*b* of the grinding stones 340 when the lower surfaces 340*b* of the grinding stones 340 are in contact with the holding surface 20*a* of the chuck table 2 is stored in the storage unit 83, and is transmitted as an electric signal to the wear amount calculating section 82.

Next, the holding surface height measuring unit 60 and the upper surface height measuring unit 62 supported by the base 73 are moved in the Z-axis direction by moving the base 73 in the grinding feed direction by using the measuring unit moving mechanism 7. The first contact 601*a* of the first gage 601 of the holding surface height measuring unit 60 thereby comes into contact with the upper surface 5*a* of the sub-chuck table 5. An amount of projection of the first gage 601 from the first cylinder 600 is measured as the height of the upper surface 5*a* of the sub-chuck table 5. In addition, the second contact 621*a* of the second gage 621 of the upper surface height measuring unit 62 comes into contact with the holding surface 20*a* of the chuck table 2. An amount of projection of the second gage 621 from the second cylinder 620 is measured as the height of the holding surface 20*a*. The measured value of the height of the upper surface 5*a* of the sub-chuck table 5 and the measured value of the height of the holding surface 20*a* are each transmitted as an electric signal to the thickness calculating section 80. Then, the thickness calculating section 80 calculates, as a first difference D1, a difference between the value of the height of the holding surface 20*a* and the value of the height of the upper surface 5*a* of the sub-chuck table 5.

Thereafter, the grinding stones 340 is temporarily separated from the holding surface 20*a* of the chuck table 2 by moving the grinding stones 340 in a +Z direction by using the grinding feed mechanism 4. Further, the first contact 601*a* and the second contact 621*a* are respectively separated from the upper surface 5*a* of the sub-chuck table 5 and the holding surface 20*a* of the chuck table 2 by moving both the holding surface height measuring unit 60 and the upper surface height measuring unit 62 in the +Z direction by the measuring unit moving mechanism 7. In addition, for example, the chuck table 2 and the grinding unit 3 are separated from each other in the horizontal direction by moving the chuck table 2 in the Y-axis direction by the horizontal moving mechanism not illustrated in the figure or the like.

Next, as illustrated in FIG. 3, the workpiece W is mounted on the holding surface 20*a* of the chuck table 2, and a suction force produced by actuating the suction source 260 is transmitted to the holding surface 20*a* through the flow passage 27. The workpiece W is thereby sucked and held on the holding surface 20*a*.

In the state in which the workpiece W is sucked and held on the holding surface 20*a*, the chuck table 2 is positioned below the grinding unit 3 by moving the chuck table 2 in the Y-axis direction by using the horizontal moving mechanism not illustrated in the figure or the like.

As illustrated in FIG. 3, the base 73 is moved in the grinding feed direction as appropriate by using the measuring unit moving mechanism 7. The first contact 601*a* of the first gage 601 of the holding surface height measuring unit 60 thereby comes into contact with the upper surface 5*a* of the sub-chuck table 5. The height of the upper surface 5*a* of the sub-chuck table 5 is measured. In addition, the second contact 621*a* of the second gage 621 of the upper surface height measuring unit 62 comes into contact with the upper surface Wa of the workpiece W. A height of the upper surface Wa of the workpiece W is measured. The measured value of the height of the upper surface 5*a* of the sub-chuck table 5 and the measured value of the upper surface Wa of the workpiece W are each transmitted as an electric signal to the thickness calculating section 80.

The thickness calculating section 80 calculates, as a second difference D2, a difference between the height of the upper surface Wa of the workpiece W and the height of the upper surface 5*a* of the sub-chuck table 5. Incidentally, the second difference D2 is a value that changes with a change in the height of the upper surface Wa of the workpiece W or the like. Further, the thickness calculating section 80 calculates a value obtained by subtracting the first difference D1 from the second difference D2 as the value of the thickness of the workpiece W.

As illustrated in FIG. 3, the driving shaft 241 is rotated about the rotational axis a by controlling the motor 242 of the rotating mechanism 24 in a state in which the first contact 601*a* is in contact with the upper surface 5*a* of the sub-chuck table 5 and the second contact 621*a* is in contact with the upper surface Wa of the workpiece W. Consequently, the driving pulley 240 coupled to the driving shaft 241 rotates, a rotational force of the driving pulley 240 is transmitted to the driven pulley 244 by the transmission belt 243, and the driven pulley 244 rotates. As the driven pulley 244 rotates, the spindle 245 connected to the driven pulley 244 rotates about the rotational axis 25 in the Z-axis direction. Thus, the chuck table 2 connected to the spindle 245 and the workpiece W held on the holding surface 20*a* of the chuck table 2 rotate about the rotational axis 25.

Next, the spindle 30 is rotated about the rotational axis 35 by using the spindle motor 32 of the grinding unit 3. The annular mount 33 connected to the lower end of the spindle 30 and the grinding stones 340 coupled to the mount 33 thereby rotate about the same rotational axis 35.

In the state in which the grinding stones 340 rotate, the ball screw 40 is rotated about the rotational axis 45 by driving the ball screw 40 using the Z-axis motor 42 of the grinding feed mechanism 4 illustrated in FIG. 1. Thus, the raising and lowering plate 43 and the grinding stones 340 supported by the raising and lowering plate 43 via the holder 44 descend in the −Z direction, and as illustrated in FIG. 3, the lower surfaces 340*b* of the grinding stones 340 abut against the workpiece W sucked and held on the holding surface 20*a*. The workpiece W is ground by further pressing down the grinding stones 340 against the workpiece W in the state in which the lower surfaces 340*b* of the grinding stones 340 abut against the workpiece W.

During the grinding, the thickness calculating section 80 successively calculates the second difference D2 as a difference between the height of the upper surface Wa of the workpiece W and the height of the upper surface 5*a* of the sub-chuck table 5. The second difference D2 changes with a change in the height of the upper surface Wa of the workpiece W due to the grinding. Further, the thickness calculating section 80 calculates a value obtained by subtracting the first difference D1 from the second difference D2 as the value of the thickness of the workpiece W. This value is also successively calculated in the thickness calculating section 80 during the grinding of the workpiece W.

When the workpiece W is ground and the height of the upper surface Wa of the workpiece W is lowered, the second gage 621 of the upper surface height measuring unit 62 moves in the −Z direction while maintaining the state in which the contact 621*a* is in contact with the upper surface Wa of the workpiece W. Accordingly, the value of the height of the upper surface Wa of the workpiece W which value is measured by the upper surface height measuring unit 62 decreases, and the second difference D2 decreases.

The value of the thickness of the workpiece W which value is calculated in the thickness calculating section 80 as a value obtained by subtracting the first difference D1 from the second difference D2 also decreases as the second difference D2 decreases. Then, when the thickness of the workpiece W measured during the grinding becomes a desired thickness set in advance, the measuring unit moving mechanism 7 raises the holding surface height measuring unit 60 and the upper surface height measuring unit 62, and the grinding feed mechanism 4 raises the grinding unit 3, so that the grinding stones 340 are separated from the workpiece W. The grinding is thus ended. The value of the thickness of the workpiece W at a time of an end of the grinding which value is calculated in the thickness calculating section 80 as described above is transmitted as an electric signal to the wear amount calculating section 82.

(Calculation of Wear Amount of Grinding Stone)

When the thickness of the workpiece W reaches the desired thickness set in advance after the workpiece W is ground, the height of the lower surfaces 340*b* of the grinding stones 340 at the time of the end of the grinding is stored in the storage unit 83. The stored value of the height of the lower surfaces 340*b* of the grinding stones 340 at the time of the end of the grinding is transmitted as an electric signal to the wear amount calculating section 82.

Then, the wear amount calculating section 82 adds the thickness of the workpiece W after the grinding, the thickness being calculated in the thickness calculating section 80, to the height of the lower surfaces 340*b* of the grinding stones 340 when the lower surfaces 340*b* of the grinding stones 340 are in contact with the holding surface 20*a* of the chuck table 2, the height being stored in advance before the grinding, and subtracts the height position of the lower surfaces 340*b* of the grinding stones 340 at the time of the end of the grinding from a resulting addition value. A wear amount of the grinding stones 340 is thereby calculated.

The holding surface height measuring unit 60 and the upper surface height measuring unit 62 can be raised and lowered in the Z-axis direction by using the measuring unit moving mechanism 7 provided to the grinding apparatus 1, and the first contact 601*a* of the holding surface height measuring unit 60 can be brought into contact with the upper surface 5*a* of the sub-chuck table 5 by disposing the sub-chuck table 5 in vicinity of the chuck table 2.

Thus, the thickness of the workpiece W can be measured by bringing the second contact 621*a* into contact with the holding surface 20*a* of the chuck table 2 while setting the first contact 601*a* in contact with the upper surface 5*a* of the sub-chuck table 5, obtaining the first difference D1 as a difference between the height of the holding surface 20*a* and the height of the upper surface 5*a* of the sub-chuck table 5, then bringing the second contact 621*a* into contact with the upper surface Wa of the workpiece W while setting the first contact 601*a* in contact with the upper surface 5*a* of the sub-chuck table 5 again in a state in which the workpiece W is held on the holding surface 20*a*, obtaining the second difference D2 as a difference between the height of the upper surface Wa of the workpiece W and the height of the upper surface 5*a* of the sub-chuck table 5, and subtracting the first difference D1 from the second difference D2. Even in a case of such a workpiece W as has a thickness equal to or more than 10 mm, for example, the thickness can be measured.

In addition, a wear amount of the grinding stones 340 can be identified by storing, in the storage unit 83 provided to the grinding apparatus 1, the height of the lower surfaces 340*b* of the grinding stones 340 when the lower surfaces 340*b* of the grinding stones 340 are in contact with the holding surface 20*a*, adding the thickness of the workpiece to the value of the height of the lower surfaces 340*b* of the grinding stones 340 when the lower surfaces 340*b* of the grinding stones 340 are in contact with the holding surface 20*a*, and subtracting the height of the lower surfaces 340*b* of the grinding stones 340 at a time of an end of grinding from a resulting addition value.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding apparatus comprising:

a chuck table configured to hold a workpiece on a holding surface;

a grinding unit configured to grind an upper surface of the workpiece held on the holding surface by a lower surface of a grinding stone;

a grinding feed mechanism configured to grinding-feed the grinding unit in a direction perpendicular to the holding surface;

a holding surface height measuring unit configured to measure a height of the holding surface;

an upper surface height measuring unit configured to measure a height of the upper surface of the workpiece held on the holding surface;

a sub-chuck table disposed so as to be separated from the chuck table by a predetermined distance in a horizontal direction;

a measuring unit moving mechanism configured to move, in the grinding feed direction, a base on which the upper surface height measuring unit and the holding surface height measuring unit are arranged; and a thickness calculating section configured to move the base by the measuring unit moving mechanism, and calculate a thickness of the workpiece using respective measured values of the upper surface height measuring unit and the holding surface height measuring unit;

the thickness calculating section calculating a first difference between the height of the holding surface, the height of the holding surface being measured by the upper surface height measuring unit, and a height of an upper surface of the sub-chuck table, the height of the upper surface of the sub-chuck table being measured by the holding surface height measuring unit, calculating a second difference between the height of the upper surface of the workpiece held on the holding surface, the height of the upper surface of the workpiece being measured by the upper surface height measuring unit, and the height of the upper surface of the sub-chuck table, the height of the upper surface of the sub-chuck table being measured by the holding surface height measuring unit, and calculating the thickness of the workpiece by subtracting the first difference from the second difference.

2. The grinding apparatus according to claim 1, further comprising:

a storage unit configured to store a height of the lower surface of the grinding stone set in contact with the holding surface; and a wear amount calculating section configured to calculate a wear amount of the grinding stone by adding the thickness of the workpiece at a time of an end of grinding, the thickness of the workpiece being calculated by the thickness calculating section, to the value stored in the storage unit, and subtracting a height position of the grinding stone at the time of the end of the grinding from a resulting addition value.

* * * * *